US007856679B1

(12) United States Patent
Finell

(10) Patent No.: US 7,856,679 B1
(45) Date of Patent: Dec. 28, 2010

(54) BATH STOOL

(76) Inventor: Rebecca M. Finell, 1152 E. Cottonwood Ln., Phoenix, AZ (US) 85048

( * ) Notice: Subject to any disclaimer, the term of this patent is extended or adjusted under 35 U.S.C. 154(b) by 1187 days.

(21) Appl. No.: 11/418,934

(22) Filed: May 5, 2006

Related U.S. Application Data

(60) Provisional application No. 60/700,393, filed on Jul. 19, 2005.

(51) Int. Cl.
*A47K 3/024* (2006.01)

(52) U.S. Cl. ..... 4/573.1; 4/578.1; 4/572.1; 4/559; 4/571.1; 297/423.11; 297/423.12

(58) Field of Classification Search ..... 4/578.1, 4/573.1, 559, 571.1, 580; 297/423.11, 423.12
See application file for complete search history.

(56) References Cited

U.S. PATENT DOCUMENTS 4,772,071 A * 9/1988 Richards ..... 297/423.12
4,937,897 A * 7/1990 Barnabie ..... 4/580
5,642,535 A * 7/1997 Frawley et al. ..... 4/559
6,854,803 B2 * 2/2005 Tomas et al. ..... 297/423.41
2005/0225150 A1 * 10/2005 Saulnier et al. ..... 297/423.11

* cited by examiner

*Primary Examiner*—Gregory L Huson
*Assistant Examiner*—Lauren Heitzer
(74) *Attorney, Agent, or Firm*—Parsons & Goltry; Michael W. Goltry; Robert A. Parsons

(57) ABSTRACT

A bath aid device includes a base formed with a padded area for kneeling. A seat is carried by a seat support mounted to the base for movement between a sitting position of the seat away from the padded area for kneeling and a stored position of the seat toward the padded area for kneeling, and a chest support mounted to a chest support extension mounted to the base for reciprocal movement between lowered and raised positions of the chest support relative to the base, and in the raised position of the chest support for pivotal movement between a deployed position of the chest support away from the padded area for kneeling and a stored position of the chest support toward the padded area for kneeling. The chest support extension is supported between the base and the seat support in the stored positions of the seat and the chest support.

20 Claims, 15 Drawing Sheets

BATH STOOL

CROSS REFERENCE TO RELATED APPLICATION

This application claims the benefit of U.S. Provisional Application No. 60/700,393, filed Jul. 19, 2005.

FIELD OF THE INVENTION

The present invention relates to a bath aid devices used to assist one in the bathing of another, especially infants and children.

BACKGROUND OF THE INVENTION

The process of one person bathing another has long been a problem for the one performing the bathing. This bathing process is normally carried out over the side of a conventional bathtub or other such washing structure. Examples of such cases are where a parent is bathing an infant or small child, or in the health care industry where a nurse or health care agent assists in the bathing of a physically handicapped or geriatric person. Where such bathing takes place over the side of a bathtub or similar structure, the process of bathing is made awkward for the one performing the bathing, and additionally may cause great discomfort to the person assisting. There has long been a need, therefore, to cure the problems associated in bathing another, wherein the person performing the bathing can do so comfortably.

SUMMARY OF THE INVENTION

According to the invention, a bath aid device for use with a bathtub, including a bathtub wall having an upper edge, for assisting one outside of the bathtub in the bathing of another within the bathtub consists of a base, formed with a padded area for kneeling, having a inner tub-facing end positionable adjacent to the bathtub wall and an opposing outer end. A seat, formed with a padded area for kneeling, is carried by a seat support, which is mounted to the outer end of the base for movement between a sitting position of the seat away from the padded area for kneeling and a stored position of the seat toward the padded area for kneeling. A chest support, formed with a padded chest engaging area, is mounted to a chest support extension and is positionable on the upper edge of the bathtub wall. The chest support extension is mounted to the inner tub-facing end of the base for reciprocal movement between a lowered position of the chest support toward the base for positioning against the upper edge of the bathtub wall and a raised position of the chest support away from the base, and in the raised position of the chest support for pivotal movement between a deployed position of the chest support away from the padded area for kneeling and a stored position of the chest support toward the padded area for kneeling, wherein the chest support extension is supported between the inner tub-facing end of the base and the seat support in the stored positions of the seat and the chest support. An engagement assembly is provided between the chest support extension and the seat support, which releasably secures the chest support extension to the seat support in the stored positions of the seat and the chest support, respectively. The engagement assembly includes an element thereof carried at a terminal edge of the chest support extension and a complemental element thereof carried at a terminal edge of the seat support. A padded ankle support is formed in the seat support on each side of the seat. The chest support includes a tub-engaging fixture having an inner end mounted to the chest support extension, an opposing outer end, an upper surface, an opposing tub-engaging surface, and a chest pad, defining the padded chest engaging area, mounted to the tub-engaging fixture overlying the upper surface thereof. Preferably, the chest pad is further mounted to the tub-engaging fixture for movement between a first position toward the inner end of the tub-engaging fixture and a second position toward the outer end of the tub-engaging fixture. A locking mechanism interacts between the chest pad and the tub-engaging fixture for releasably securing the chest pad at the first and second positions thereof and at selected positions therebetween.

According to the invention, a bath aid device for use with a bathtub, including a bathtub wall having an upper edge, for assisting one outside of the bathtub in the bathing of another within the bathtub consists of a base, formed with a padded area for kneeling, having an inner tub-facing end positionable adjacent to the bathtub wall and an opposing outer end. A seat, formed with a padded area for sitting, is carried by a seat support mounted to the outer end of the base for movement between a sitting position of the seat away from the padded area for kneeling and a stored position of the seat toward the padded area for kneeling. In this embodiment, a chest support extension has opposing inner and outer faces. A chest support, formed with a padded chest engaging area, is mounted to the chest support extension for movement between a first position away from the inner face of the chest support extension and a second position in juxtaposition with the inner face of the chest support extension. The chest support is positionable on the upper edge of the bathtub wall in the first position of the chest support. The chest support extension is mounted to the inner tub-facing end of the base for reciprocal movement between a lowered position of the chest support toward the base for positioning against the upper edge of the bathtub wall in the first position of the chest support and a raised position of the chest support away from the base, and in the raised position of the chest support for pivotal movement between a deployed position of the chest support away from the padded area for kneeling and, in the second position of the chest support, a stored position of the chest support toward the padded area for kneeling. In the stored positions of the seat and the chest support, and the second position of the chest support, the chest support extension supported between the inner tub-facing end of the base and the seat support, and the chest support located between the seat and the inner face of the chest support extension. An engagement assembly is provided between the chest support extension and the seat support, which releasably secures the chest support extension to the seat support in the stored positions of the seat and the chest support, respectively. The engagement assembly includes an element thereof carried at a terminal edge of the chest support extension and a complemental element thereof carried at a terminal edge of the seat support. A padded ankle support is formed in the seat support on each side of the seat. In this embodiment, the chest support consists of a tub-engaging fixture having an inner end, an opposing outer end, an upper surface, and an opposing tub-engaging surface. The inner end of the tub-engaging fixture is mounted to the chest support extension for movement between the first and second positions of the chest support, and a chest pad, defining the padded chest engaging area, is mounted to the tub-engaging fixture overlying the upper surface thereof. The chest pad is further mounted to the tub-engaging fixture for movement between a first position toward the inner end of the tub-engaging fixture and a second position toward the outer end of the tub-engaging fixture. A locking assembly interacts between the chest pad and the tub-engaging fixture for releasably securing the chest pad at the first and second positions thereof and at selected positions therebetween.

According to the invention, a bath aid device for use with a bathtub, including a bathtub wall having an upper edge, for assisting one outside of the bathtub in the bathing of another within the bathtub consists of a base, formed with a padded area for kneeling, having a inner tub-facing end positionable adjacent to the bathtub wall and an opposing outer end. In this embodiment, an upstanding support extends upwardly from the inner tub-facing end terminating with an upper end. A seat, formed with a padded seating area, is carried by a seat support having an inner end and an opposing outer end. The inner end of the seat support is mounted to the outer end of the base for movement of the seat support between a sitting position of the seat away from the padded area for kneeling and a stored position of the seat toward the padded area for kneeling. A chest support, formed with a padded chest engaging area, is mounted to a chest support extension and is positionable on the upper edge of the bathtub wall. The chest support extension is mounted to the upstanding support for reciprocal movement between a lowered position disposing the chest support toward the base for positioning against the upper edge of the bathtub wall and a raised position disposing the chest support away from the base, and in the raised position for pivotal movement between the raised position disposing the chest support in a deployed position away from the padded area for kneeling and a lowered, generally horizontal position disposing the chest support in a stored position toward the padded area for kneeling. In the stored position of the seat, the upper end of the upstanding support and the outer end of the seat support define a generally horizontal plane. In the stored positions of the seat and the chest support, the chest support extension is supported in its lowered, generally horizontal position between the upper end of the upstanding support and the outer end of the seat support. An engagement assembly is provided between the chest support extension and the seat support, which releasably secures the chest support extension to the seat support in the stored positions of the seat and the chest support, respectively. The engagement assembly includes an element thereof carried at a terminal edge of the chest support extension and a complemental element thereof carried at the outer end of the seat support. A padded ankle support is formed in the seat support on each side of the seat. The chest support consists of a tub-engaging fixture having an inner end mounted to the chest support extension, an opposing outer end, an upper surface, an opposing tub-engaging surface, and a chest pad, defining the padded chest engaging area, mounted to the tub-engaging fixture overlying the upper surface thereof. The chest pad is further mounted to the tub-engaging fixture for movement between a first position toward the inner end of the tub-engaging fixture and a second position toward the outer end of the tub-engaging fixture. A locking assembly interacts between the chest pad and the tub-engaging fixture for releasably securing the chest pad at the first and second positions thereof and at selected positions therebetween.

Consistent with the foregoing summary of preferred embodiments, and the ensuing detailed description, which are to be taken together, the invention also contemplates associated embodiments.

BRIEF DESCRIPTION OF THE DRAWINGS

Referring to the drawings.

DETAILED DESCRIPTION OF PREFERRED EMBODIMENTS

Figure 1:
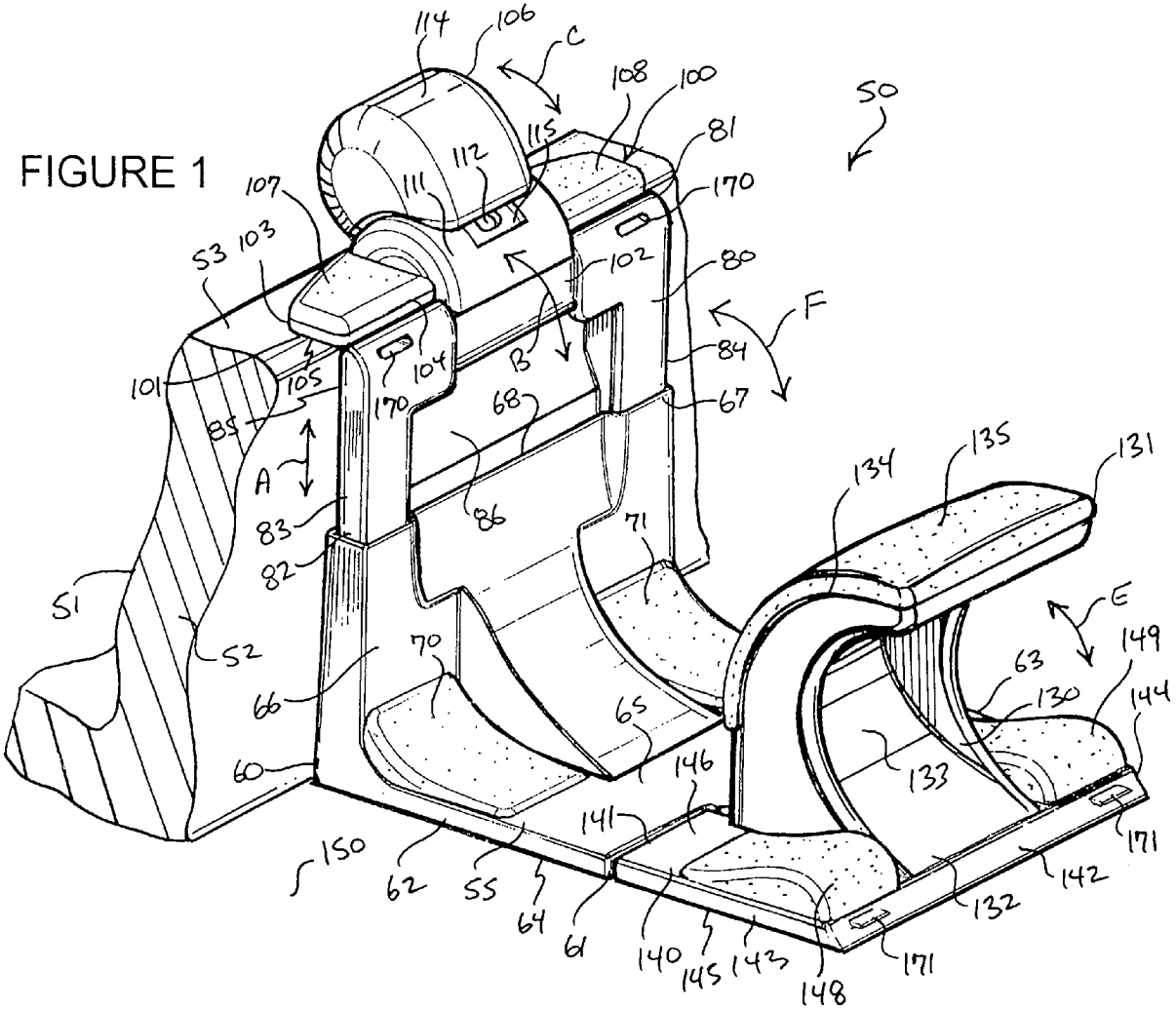
FIG. 1 is a perspective view of a bath aid device constructed and arranged in accordance with the principle of the invention and shown as it would appear in an open position associated with a bathtub.
Figure 2:
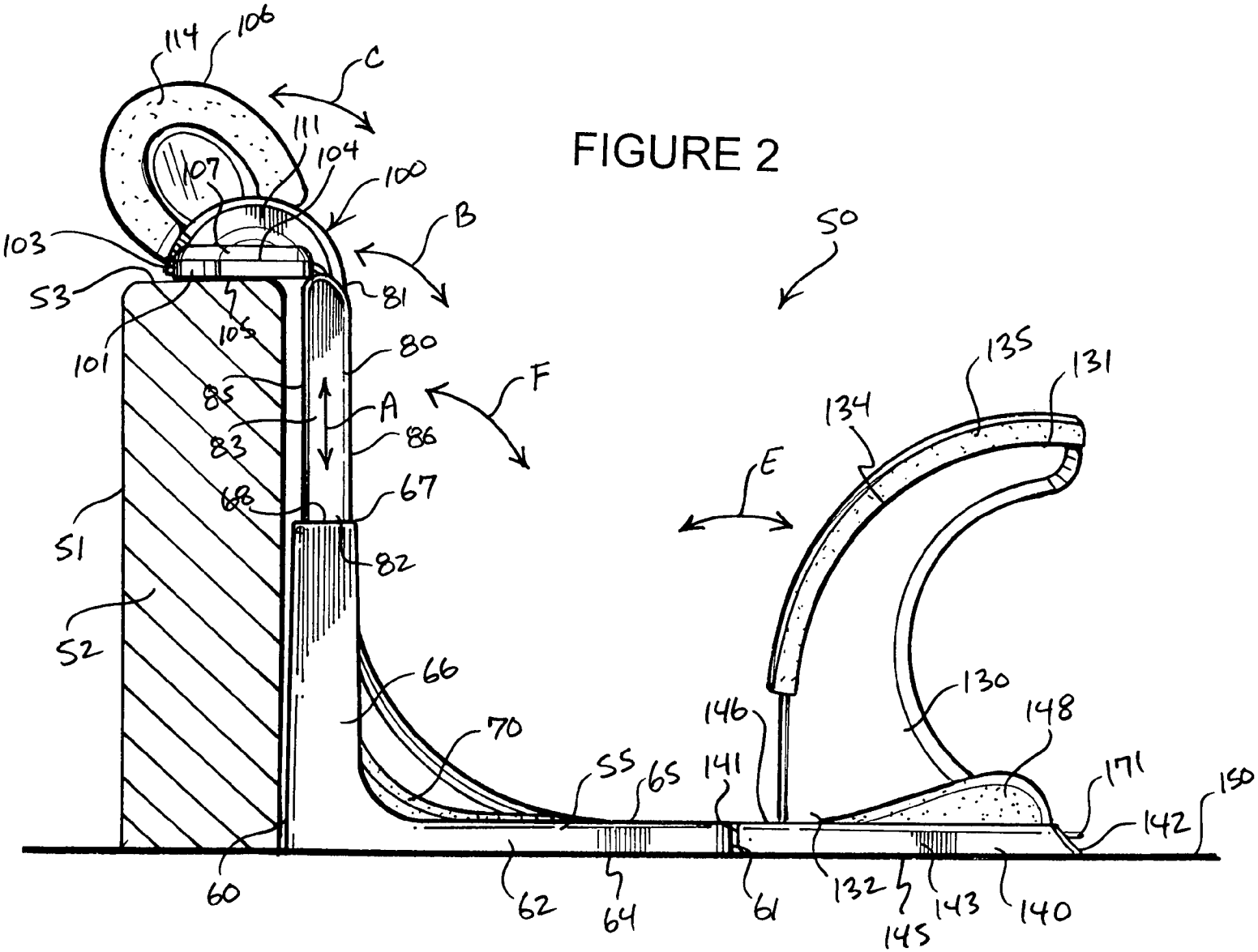
FIG. 2 is a side elevational of the bath aid device of FIG. 1 shown as it would appear associated with the bathtub.
Figure 14:
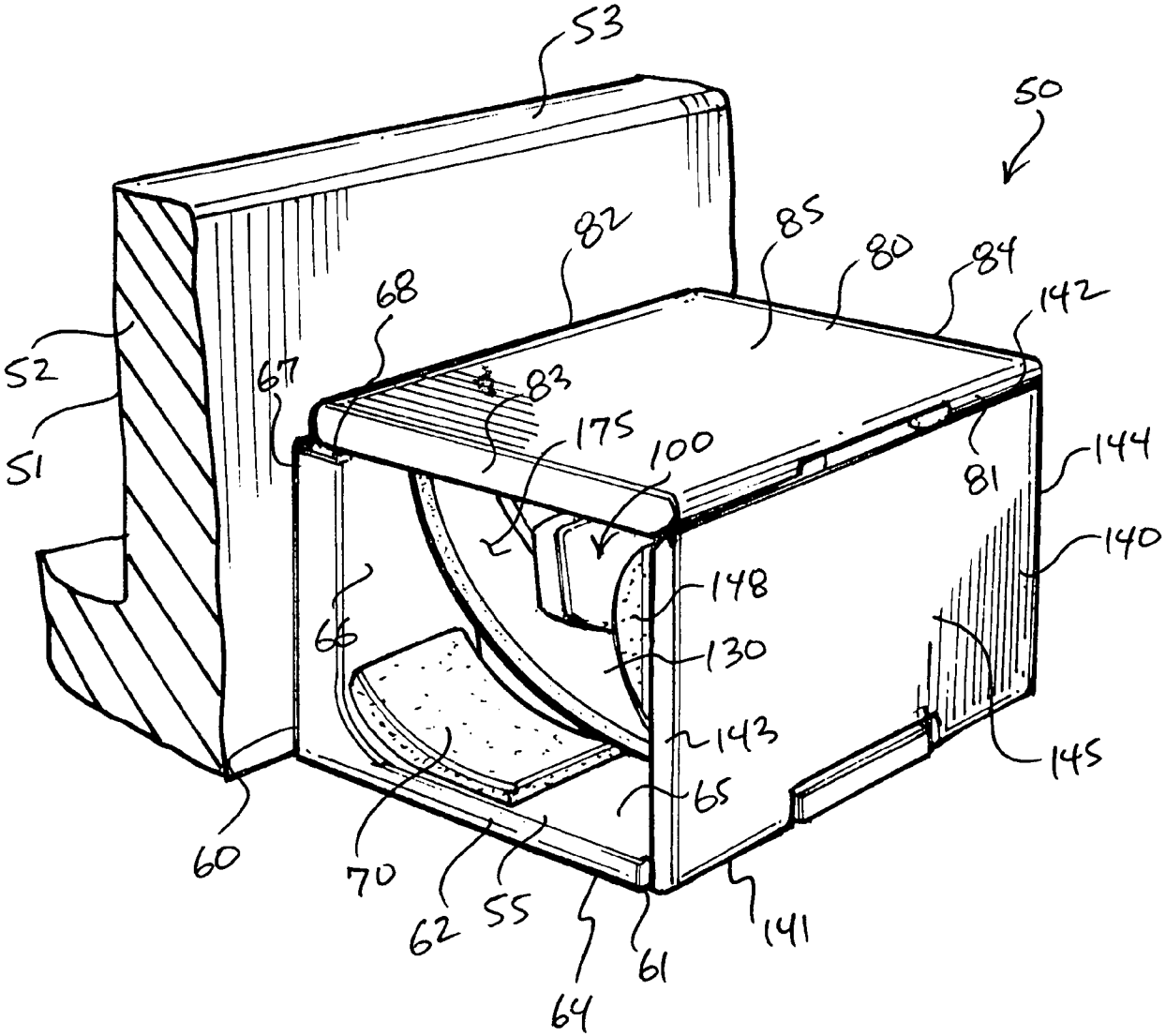
Figure 15:
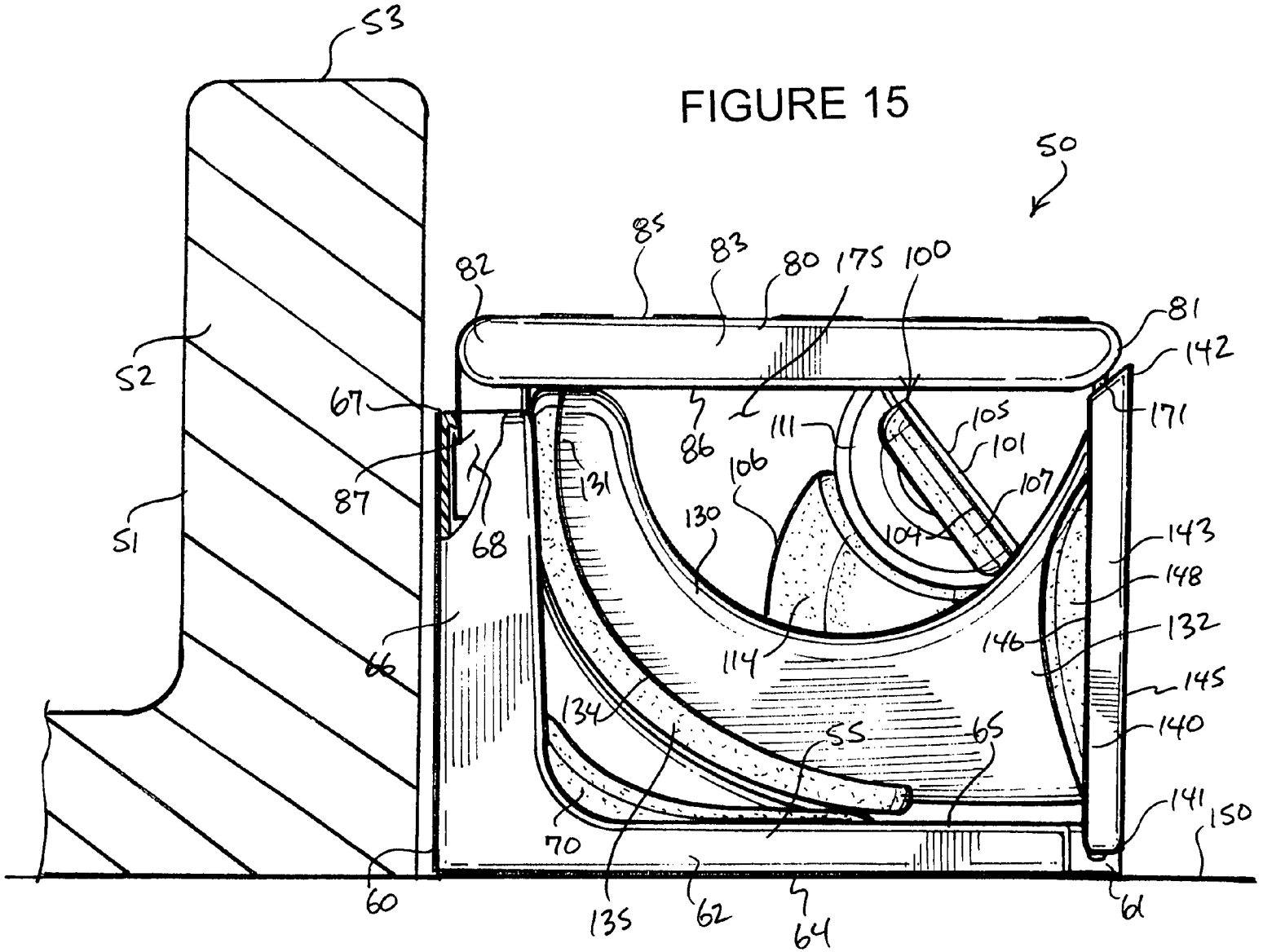
FIG. 15 is a side elevational view of the bath aid device of FIG. 14 shown as it would appear in the closed position.
Figure 17:
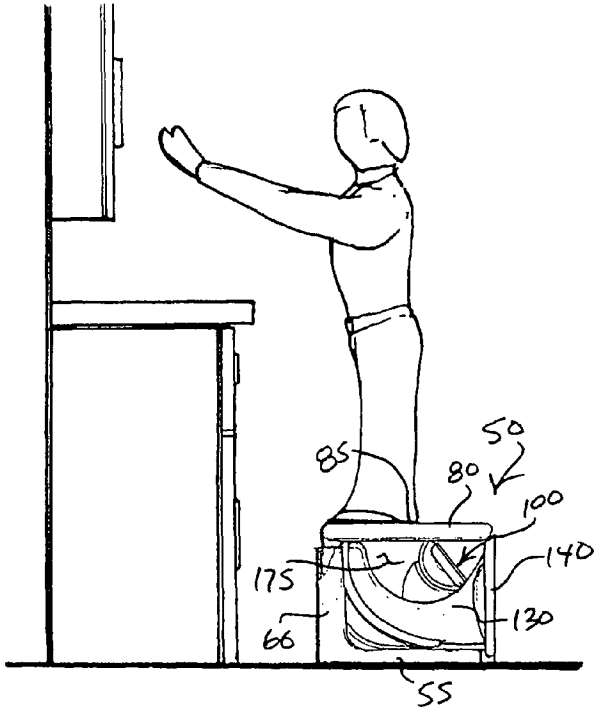
FIG. 17 is a side elevational of the bath aid device shown as in would appear in the closed position as illustrated in FIG. 14 and supporting a user standing thereon.
Figure 16:
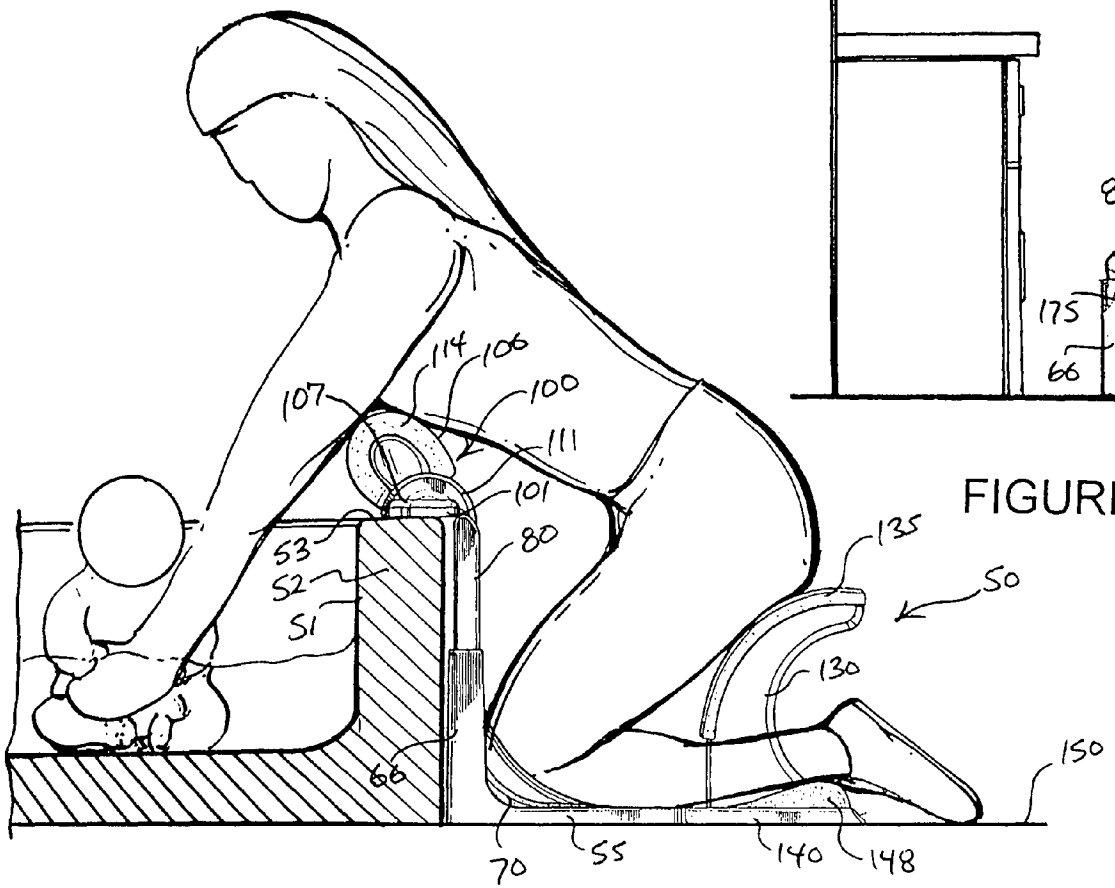
FIG. 16 is a side elevational view of the bath aid device of FIG. 1 shown as it would appear in the open position and in use by one person bathing another located in a bathtub.

Turning now to the drawings, in which like reference characters indicate corresponding elements throughout the several views, attention is first directed to FIG. 1 in which there is seen a bath aid device generally designated by the reference character 50 for use with a bathtub 51 including a bathtub wall 52 having an upper edge 53, wherein bath aid device 50 assists one outside of the bathtub in the bathing of another within the bathtub, in accordance with the principle of the invention. Bath aid device 50 is movable between an open position as illustrated in FIGS. 1, 2, and 16, and a closed position as shown in FIGS. 14, 15, and 17. In its open position, bath aid device 50 is used to assist one outside of a bathtub in the bathing of another within the bathtub as shown in FIG. 16. In its closed position, bath aid device 50 is a stool, namely, low bench or portable support for the feet or knees or for sitting upon. FIG. 17 shows bath aid device 50 in its closed position forming a stool upon which a user is standing so as to be supported at an elevated location. Bath aid device 50 is generally constructed of plastic, aluminum, wood, or other substantially rigid material or combination of materials. Bath aid device 50 incorporates a number of padded areas onto which a user may sit, kneel, and present his or her chest against and his or her ankles against, which are each fashioned of padding material such as foam rubber or other selected form of padding material for providing padded comfort.

Figure 5:
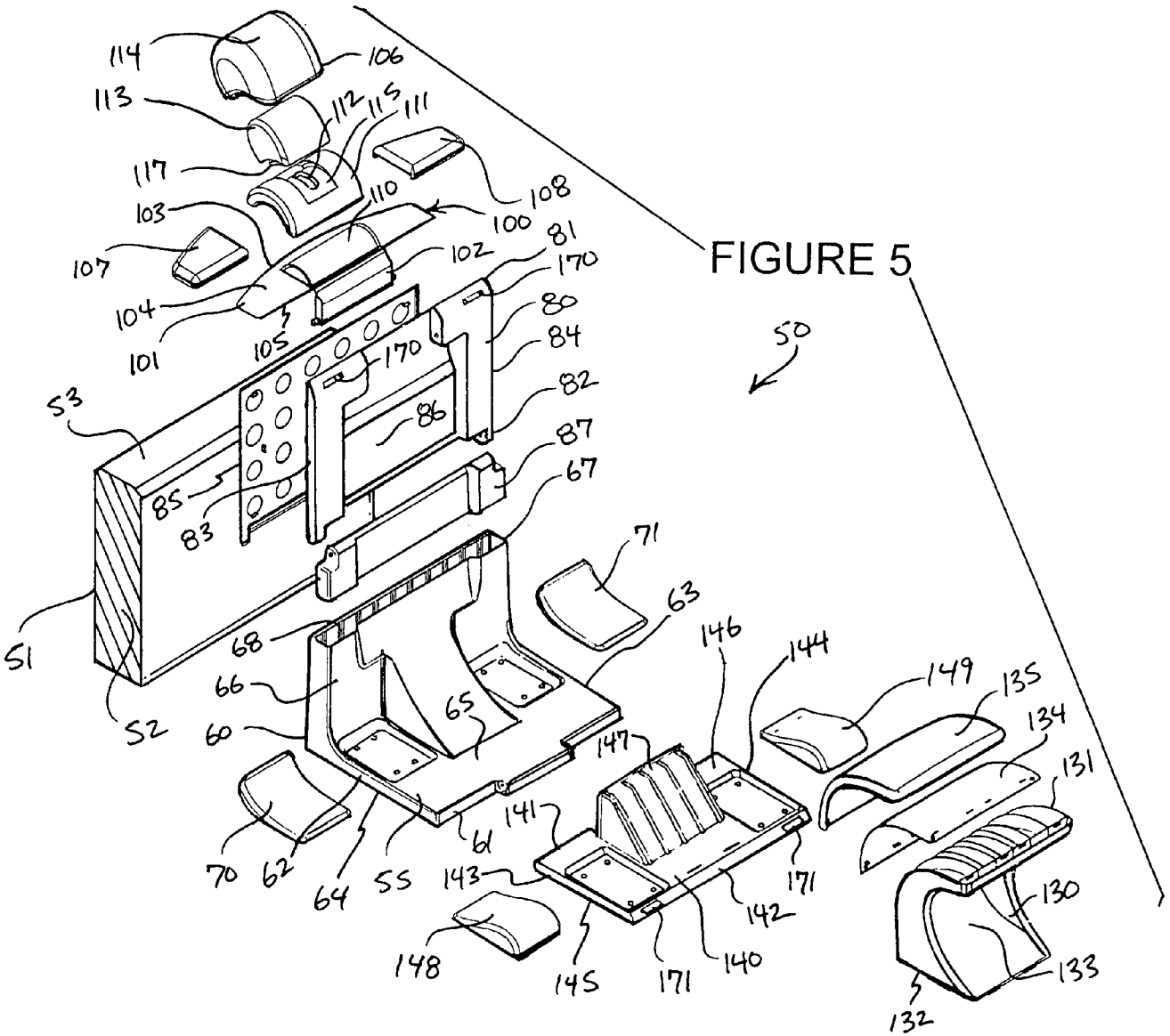
FIG. 5 is an exploded perspective view of the bath aid device of FIG. 1.

Referring to FIGS. 1 and 5, bath aid device 50 includes a base 55 consisting of an integrated body having opposed inner and outer ends 60 and 61, opposed sides 62 and 63, a bottom 64 positionable against a supporting surface, and an opposed top 65. Inner end 60 is the tub-facing end of bath aid device 50. Looking also to FIG. 6, an upstanding support 66 is attached to base 50 at inner end 60, and projects upwardly therefrom terminating with an upper end 67. Upstanding support 66 defines a socket 68, as seen in FIG. 5, which extends into upstanding support 66 through upper end 67 and which forms a holder for a chest support extension 80 of bath aid device 50. Base 50 is formed with a padded area for kneeling, which in this embodiment consists of opposed knee pads 70 and 71 applied to top 65 of base 50. Knee pads 70 and 71 are formed of foam rubber or other selected padding material, are applied to top 65 with a suitable adhesive or by overmolding, and are located adjacent sides 62 and 63, respectively, at upstanding support 66.

Figure 11:
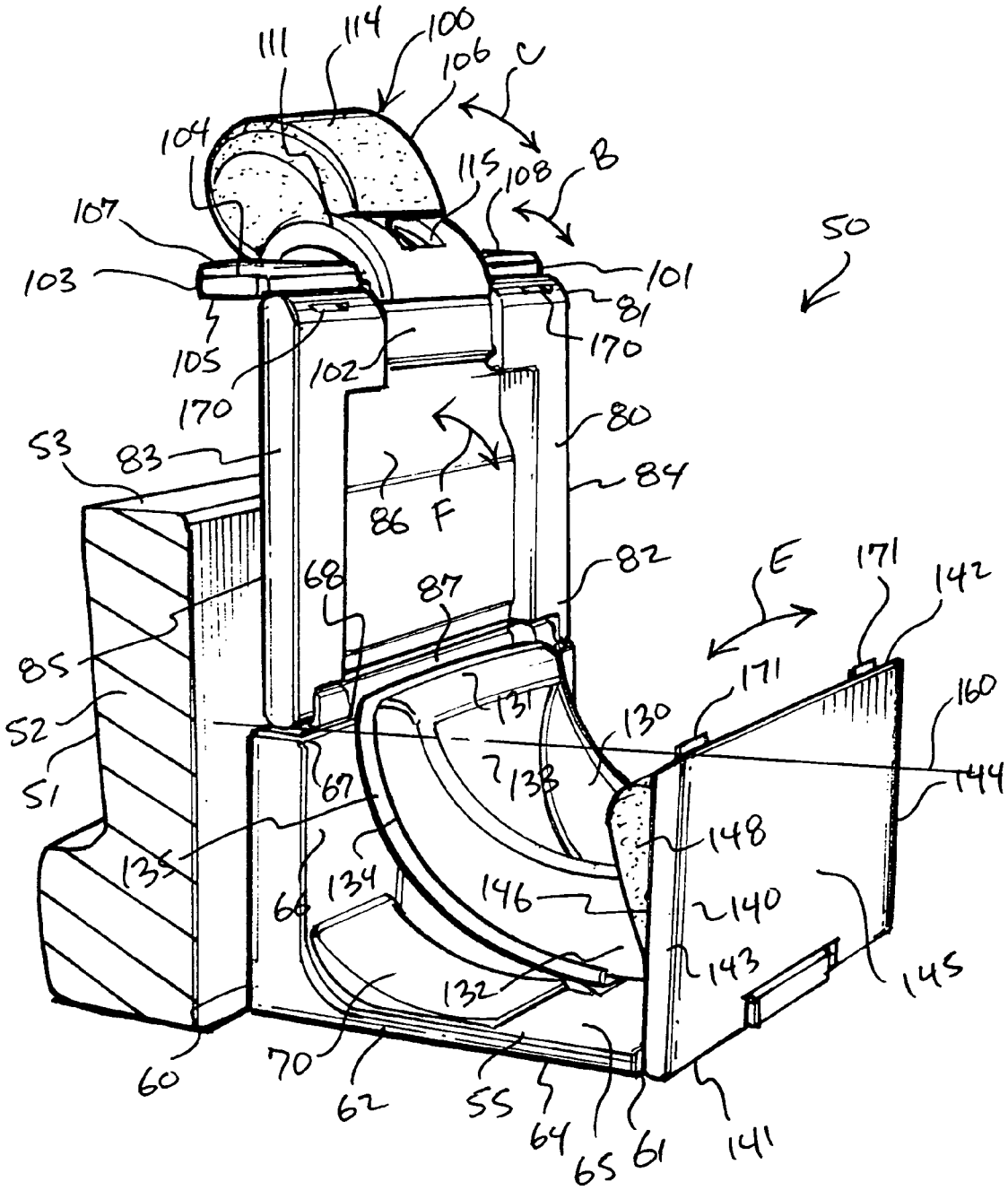

Chest support extension 80 consists of an integrated body including opposing upper and lower ends 81 and 82, opposed sides 83 and 85, and opposing outer and inner faces 85 and 86. Upper end 81 of chest support extension 80 is a terminal edge of chest support extension 80. Lower end 82 is pivotally attached to an elongate insert 87 (FIGS. 5 and 6) with a conventional pivot, such as one or more shafts or pins on which lower end 82 pivots, or a hinge, such as a living hinge or other suitable hinge form. Lower end 82 and elongate insert 87 are concurrently received in socket 68, whereby chest support extension 80 and elongate insert 87 are concurrently reciprocally adjustable in socket 68 as generally indicated by the double arrowed line A in FIGS. 1 and 2 between a raised position as shown in FIG. 11 and generally a lowered position as generally depicted in FIGS. 1 and 2.

Figure 12:
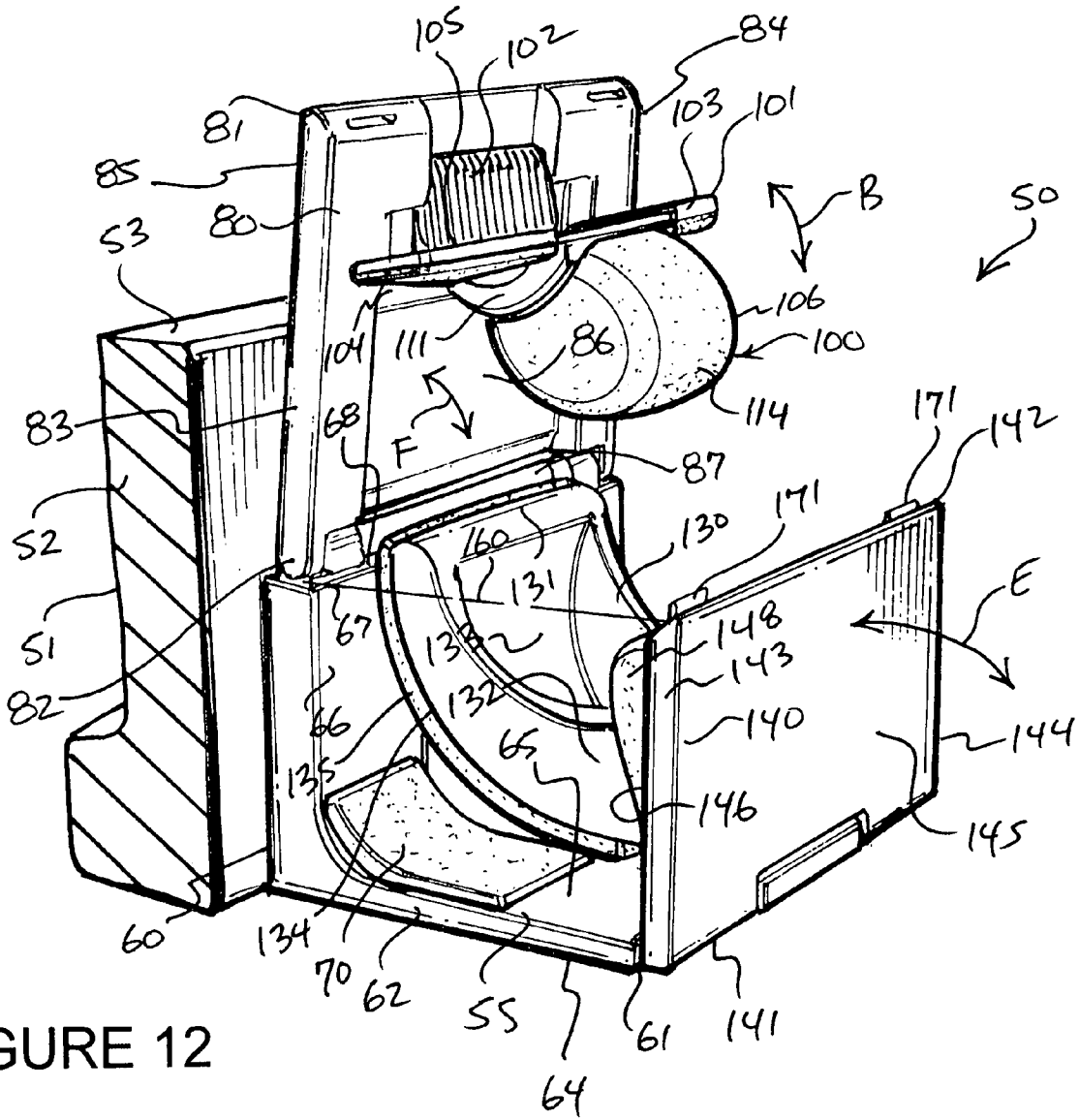

A chest support 100 is formed with a padded chest engaging area, is mounted to upper end 81 of chest support extension 80, and is positionable on upper edge 53 of bathtub wall 52 as seen in FIGS. 1 and 2. Chest support 100 consists of a tub-engaging plate or fixture 101 having an inner end 102 mounted to upper end 82 of chest support extension 80, an opposing outer end 103, an upper surface 104, an opposing tub-engaging surface 105, and a chest pad 106, defining the padded chest engaging area, mounted to fixture 101 overlying upper surface 104. According to the principle of the invention, inner end 102 is mounted to chest support extension 80 for pivotal movement with a conventional pivot, such as one or more shafts or pins on which inner end 102 pivots, or a hinge, such as a living hinge or other suitable hinge form. The pivot point between inner end 102 and chest support extension 80 is located at inner face 86 just inboard of outer end 81, whereby chest support 100 is pivots at the pivot point as generally indicated by the arcuate double arrowed line B in FIGS. 1, 2, and 12 between a first or tub-engaging position away from inner face 86 of chest support extension 80 away from outer face 85 of chest support extension 80 as seen in FIGS. 1 and 2 and a second or tub-disengaging position as shown in FIG. 12 in juxtaposition with inner face 86 of chest support extension 80. In the tub-engaging position of chest support 100 as seen in FIG. 1, fixture 101 is cantilevered extending away from outer face 85 of chest support 100.

Figure 7:
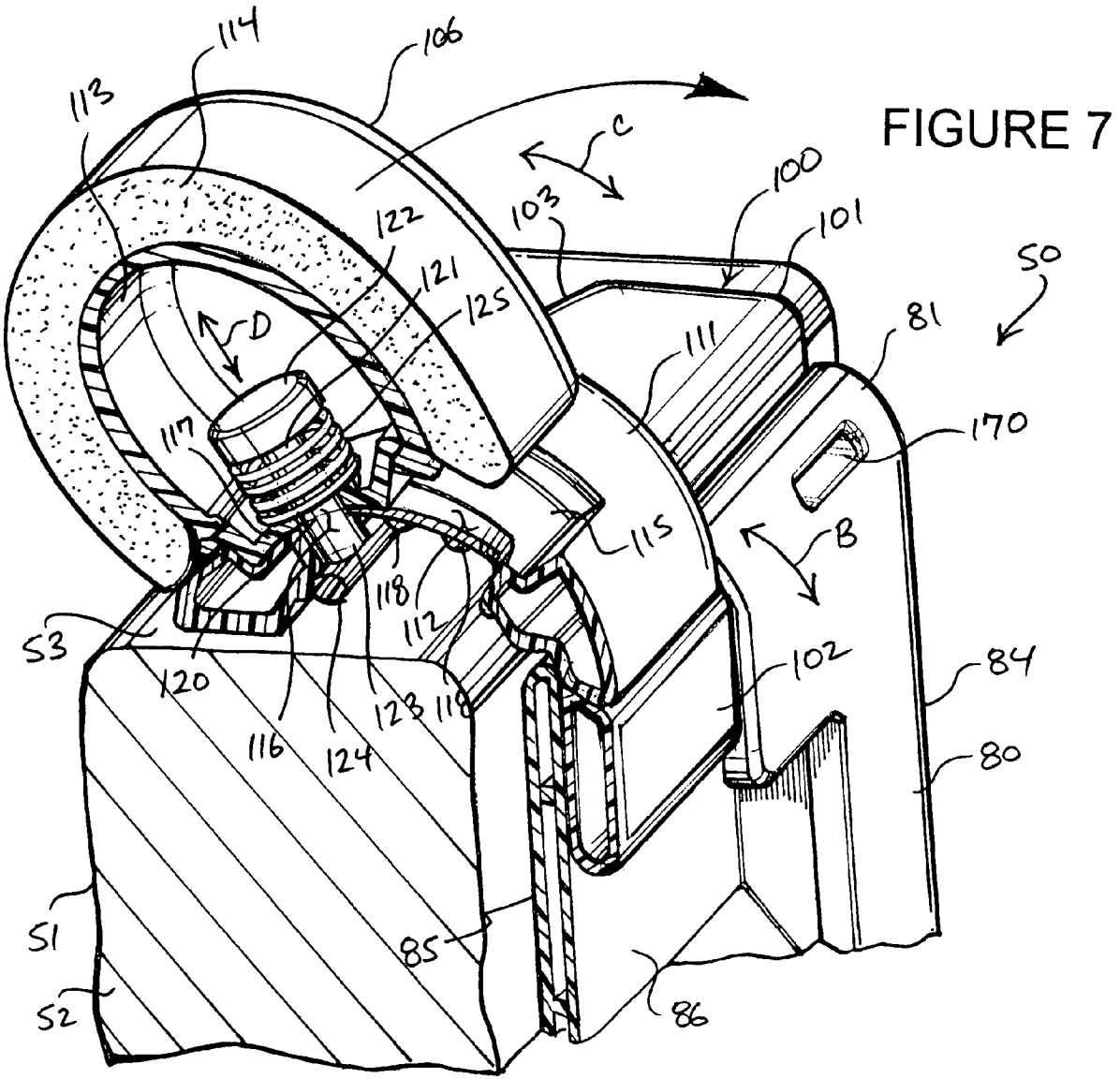
FIG. 7 is a vertical sectional view taken along line 7-7 of FIG. 1 of a chest support, incorporating a locking mechanism, of the bath aid device.
Figure 8:
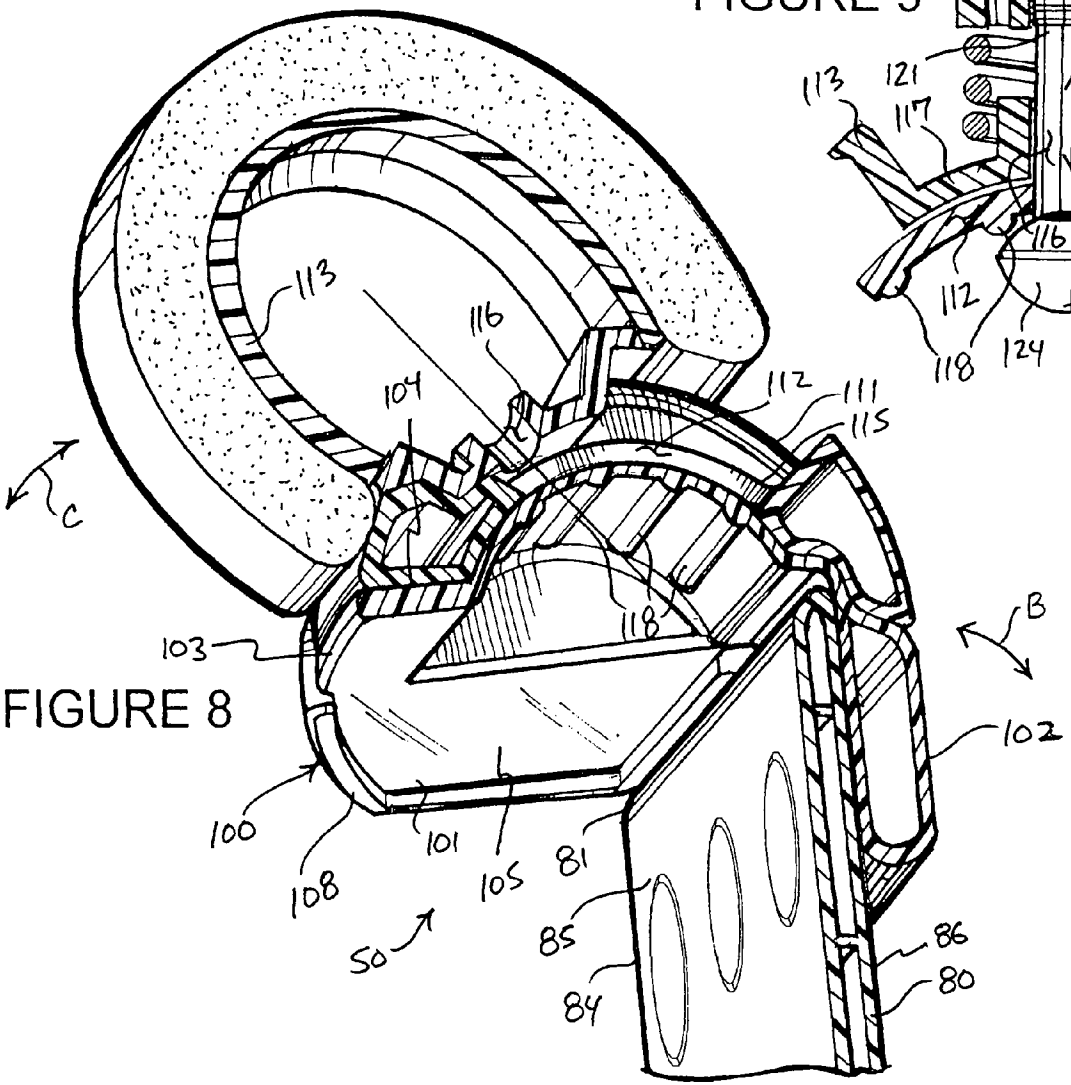
FIG. 8 is a vertical sectional view of the chest support of FIG. 8 with portions of the locking mechanism removed for illustrative purposes.

Upper surface 104 of fixture 101 is formed with a central, raised feature 110, onto which is set and secured a carriage 111. Carriage 111 is part of fixture 101 and is secured to raised feature 110 with adhesive, screws, rivets, or the like. Carriage 111 is generally arcuate in shape, and is formed with a central, elongate slot 112 situated within a broad groove 115 formed in carriage 111. Slot 112 extends from adjacent to inner end 102 of fixture 101 to adjacent to outer end 103 of fixture 101. A pad support 113, which is substantially enveloped by a pad 114 formed of foam rubber or other suitable padding material, is set onto carriage 111 as seen in FIG. 8 and projects away from upper face 104 of fixture 101, whereby an opening 116 formed in the lower end of pad support 113 registers with slot 112. Pad support 113, which is hollow, and pad 114 together constitute chest pad 106, in which pad 114 forms a padded area of chest pad 106 onto which a user presents his or her chest. The lower end of pad support 113 set onto carriage 111, and which is formed with opening 116, is a tongue 117, which is received by groove 115. Chest pad 106 is moveable in groove 115 relative to directions as generally indicated by the arcuate double arrowed line C in FIGS. 1, 2, and 7, between a first or rearward position toward inner end 102 of fixture 101 and a second or forward position toward outer end 103 of fixture 101. The interaction between tongue 117 and groove 115 limits the movement of chest pad 106 between its rearward and forward positions. Because carriage 111 is generally arcuate in shape, the movement path of chest support 106 between its rearward and forward positions is also correspondingly generally arcuate.

Figure 9:
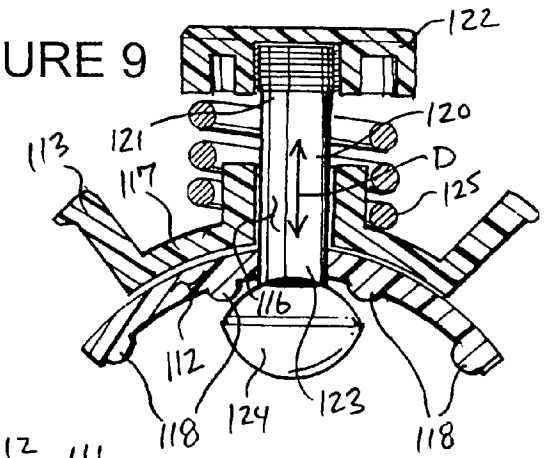
FIG. 9 is a vertical sectional view of the locking mechanism of FIG. 7.

A locking assembly interacts between chest pad 106 and fixture 101, which releasably secures chest pad 106 at the first and second positions thereof and at selected positions therebetween. The locking assembly includes a plurality of substantially equally spaced-apart ribs 118 formed on the underside of carriage 111 as shown in FIGS. 7-9 on either side of slot 112. A pin 120 extends concurrently through slot 112 and opening 116. Pin 120 has an upper end 121 formed with an enlarged head 122 located in pad support 113 on one side of tongue 117, and a lower end 123 formed with an elongate key 124 disposed alongside the underside of carriage 111 interacting with ribs 118. A compression spring 125 encircles pin 120, and is captured between the inner side of pad support 113 encircling opening 116 and head 122. Spring 125 acts against pad support 113 and head 112 biasing pin 120 upwardly away from carriage 111 in the direction generally indicated by the arrowed line D in FIGS. 7 and 9 thereby urging key 124 against the underside of carriage 111. Although compression spring 125 is preferred for biasing pin 120 as herein described, other spring forms can be used for providing the described bias without departing from the invention.

To adjust chest pad 106 between its first and second positions, it is taken up by hand and forcibly urged between its first and second positions. As chest pad 106 is moved, key 124 runs along the underside of carriage 111 and interacts with ribs 118 moving pin 120 in reciprocal directions as key 124 runs over ribs 118 and into the valleys formed between ribs 118, whereby the bias applied to pin 120 provided by compression spring 125 snaps key 124 into place in the valleys formed between ribs 118. Each valley formed between ribs 118 is an engagement point for key 124, and corresponds to a position at which chest pad 106 may be placed. Accordingly, the locking assembly herein described allows chest pad 106 to be not only moved between its first and second positions, but also secures chest pad 106 at its first position, its second position, and at selected positions therebetween, according to the principle of the invention. In the immediate embodiment, there are approximately five positions at which chest pad 106 may be placed between its first and second positions, although the locking assembly may be configured to provide less or more such intermediate positions, if desired.

The locking assembly disclosed herein is preferred insofar as it is simple in structure, inexpensive, and efficient. However, other suitable forms of locking assemblies interacting between fixture 101 and chest pad 106 capable of performing the same function can be used without departing from the invention, such as a ratchet assembly, a gear assembly, a rack and pinion assembly, a rack and pawl assembly, etc.

Fixture 101 is formed with a padded area for arms and elbows, which in this embodiment consists of opposed arm pads 107 and 108 applied to upper surface 104 of fixture 101. Arm pads 107 and 108 are formed of foam rubber or other selected padding material, are applied to upper surface 104 with a suitable adhesive or by overmolding, and are located on either side of carriage 111 and chest pad 106.

Figure 6:
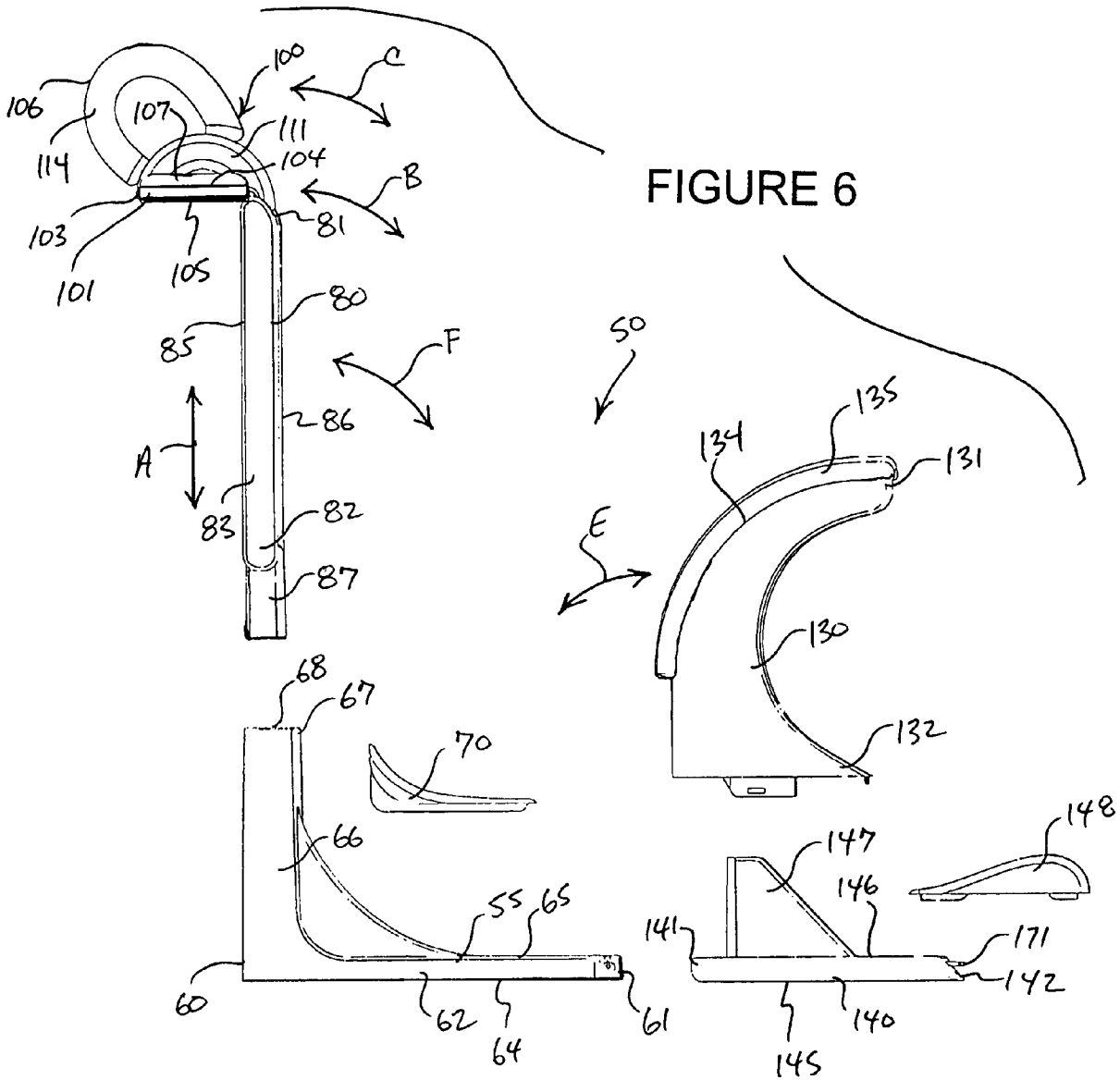
FIG. 6 is a partially exploded side elevational view of the bath aid device of FIG. 1.

Referring back to FIGS. 1 and 5, bath aid device 50 further includes a seat 130, formed with a padded seating area, carried by a seat support 140. Seat support 140 consists of an integrated body having opposed inner and outer ends 141 and 142, opposed sides 143 and 144, a bottom 145, and an opposed top 146. Seat support 140 is formed with a pedestal 147, which projects upwardly from top 146 of seat support 140 as shown in FIG. 6 between sides 143 and 144 adjacent to inner end 141 as shown in FIG. 5. Outer end 142 of seat support 140 is a terminal edge of seat support 140.

Seat 130 consists of an integrated body having opposing upper and lower ends 131 and 132, and opposing inner and outer faces 133 and 134. The padded seating area of seat 130 is provided by a seat pad 135 applied to outer face 133 of seat 130. Seat 130 is hollow, and is set lower end 132 first over pedestal 147 and then secured thereto with adhesive, screws, rivets, or the like. Seat 130 projects upwardly from top 146 of seat support 140, in which inner face 133 faces downwardly toward top 146 and outer end 142 of seat support 140, and outer face 134, with seat pad 135 applied thereto, faces upwardly away from top 146 toward inner end 141 of seat support 140.

Seat support 140 is formed with a padded ankle support area, which in this embodiment consists of opposed ankle pads 148 and 149 applied to top 146. Ankle pads 148 and 149 are applied to top 146 with a suitable adhesive or by overmolding, and are located adjacent to sides 143 and 144, respectively, on either side of seat 130 toward outer end 142. Inner end 141 of seat support 140 is mounted to outer end 61 of base 55 with a conventional pivot, such as one or more shafts or pins on which lower end 82 pivots, or a hinge, such as a living hinge or other suitable hinge form. Seat support 140 pivots at the pivotal attachment point between inner end 141 of seat support 140 and outer end 61 of base 55 as generally indicated by the arcuate double arrowed line E in FIGS. 1 and 2 between a first or deployed position as shown in FIGS. 1 and 2 away from base 55 disposing seat 130 in a sitting position away from the padded area for kneeling formed in base 55, and a second or stored position as shown in FIG. 11 toward base 55 disposing seat 130 in a stored position toward and against top 65 of base 55 toward the padded area for kneeling.

In its open position as shown in FIGS. 1, 2, and 16, bath aid device 50 is used to assist one outside of a bathtub in the bathing of another within the bathtub as shown in FIG. 16. In the open position of bath aid device 50, seat 130 is disposed in its sitting position, chest support extension 80 projects upwardly from socket 68 extending into upper end 67 of upstanding support 66 to chest support 100 at upper end 81 of chest support extension 80, and chest support 100 is positioned in its tub-engaging position. Bottom 64 of base 55 is set onto the floor 150 adjacent to bathtub wall 52, inner end 60 is directed against bathtub wall 52, and bottom 145 of seat support 140 is set onto floor 150. Upstanding support 66 extends upwardly along the outer surface of bathtub wall 52 to upper end 67, and chest support extension 80 extends upwardly along the outer surface of bathtub wall 52 from upper end 67 of upstanding support 66 to chest support 100. Chest support 100 is located above upper edge 53 of bathtub wall 52, and tub-engaging surface 105 is set onto upper edge 53 supporting chest support 100 on upper edge 53.

Figure 3:
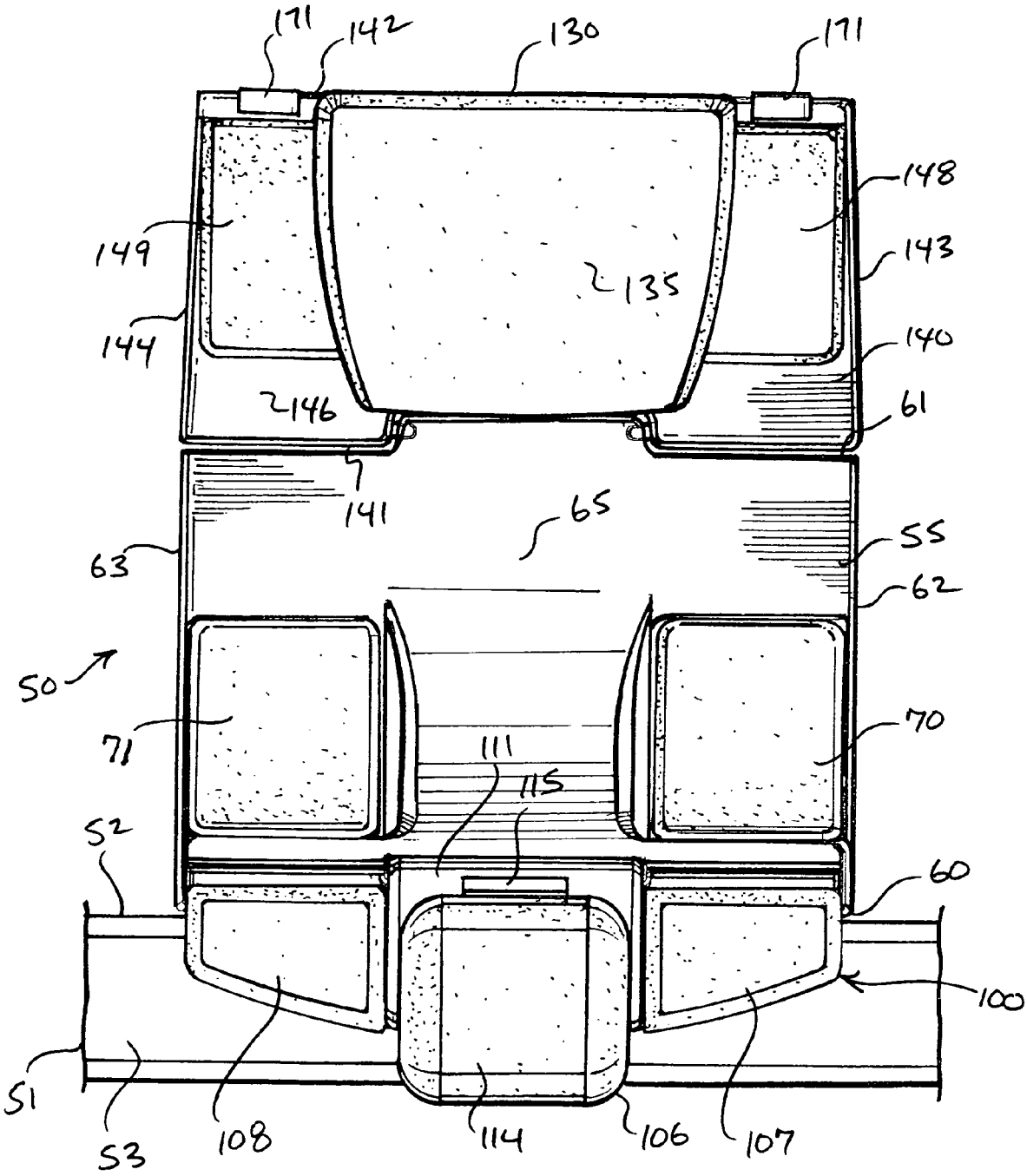
FIG. 3 is a top plan view of the bath aid device of FIG. 1 shown as it would appear associated with the bathtub.
Figure 4:
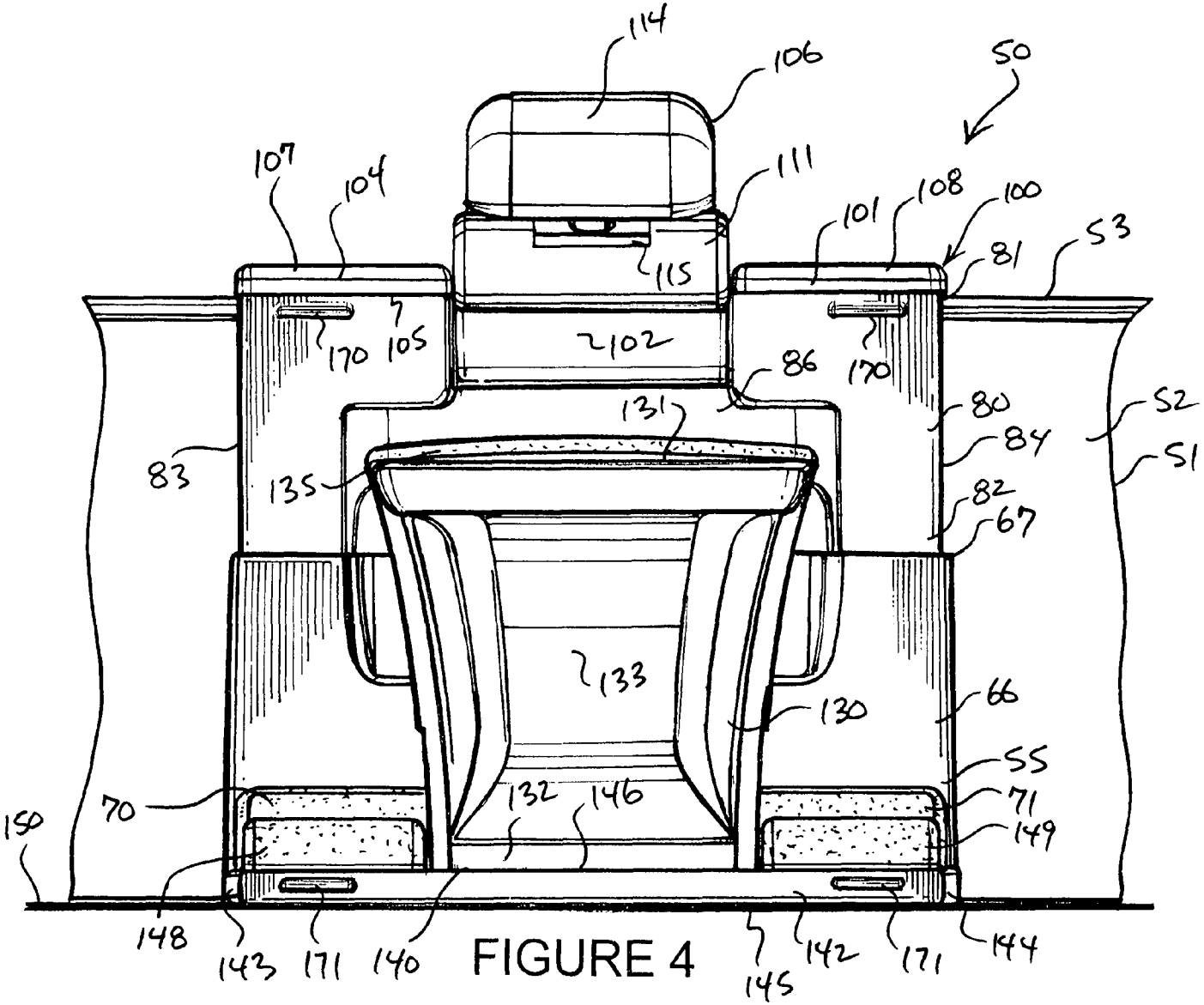
FIG. 4 is a front elevational view of the bath aid device of FIG. 1 shown as it would appear associated with the bathtub.

The reciprocal adjustment of chest support extension 80 relative to base 55 allows chest support extension 80 to be moved between its raised and lowered positions for concurrently adjusting chest support 100 between raised and lowered positions to accommodate the height of bathtub wall 52 from its lower end at floor 150 to its upper edge 53. Because the height of the bathtub walls of different bathtubs can be different, the reciprocal adjustment of chest support extension 80 to base 55 allows bath aid device to be used with tubs having different bathtub wall heights, in accordance with the principle of the invention. In the present example, chest support extension 80 is normally held by a user in its raised position before presenting inner end 60 of base 55 against bathtub wall 52. After presenting inner end 60 of base 55 against bathtub wall 52 disposing upstanding support 66 and chest support extension 80 alongside bathtub wall 52, chest support 100 is raised relative to upper edge 53 of bathtub wall 52. At this point, the user may then move chest support extension 80 from its raised position toward its lowered position to thereby concurrently move chest support 100 from a raised position away from upper edge 53 to a lowered position presenting tub-engaging surface 105 against upper edge 53 of bathtub wall 52 as shown in FIGS. 1, 2, and 16. As a matter of disclosure, FIG. 2 is a side elevational of bath aid device 50 shown as it would appear open and associated with bathtub 51, FIG. 3 is a top plan view of bath aid device 50 shown as it would appear associated with bathtub 51, and FIG. 4 is a front elevational view of bath aid device 50 shown as it would appear associated with bathtub 51.

After disposing bath aid device 50 in conjunction with bathtub 51 as herein described, it is prepared to be used by one outside of bathtub 51 in the bathing of another within bathtub 51 as shown in FIG. 16. To use bath aid device 50, the user sits on seat 130, kneels on kneel pads 70 and 71, rests her ankles on ankle pads 148 and 149, and leans forward toward bathtub 51 bringing her chest against chest pad 106, whereby the user is supported in a forward leaning position by bath aid device 50 toward bathtub 51 providing the user with comfortable, supported access to a person to be bathed located in bathtub 51. In accordance with the principle of the invention, chest support 106 may be adjusted as needed between its rearward position away from bathtub 51 and its forward position toward bathtub 51 to provide the desired comfort and to provide better access to tub 51. The padded area for kneeling provided by base 55, the padded chest engaging area provided by chest pad 106, the padded area for sitting provided by seat 130, and the padded ankle support area provided by seat support 140 make bath aid device 50 comfortable to sit upon as herein described. The padded area for arms and elbows provided by chest support 100 likewise provides a comfortable area for the user to lean her arms/elbows against as needed.

Figure 10:
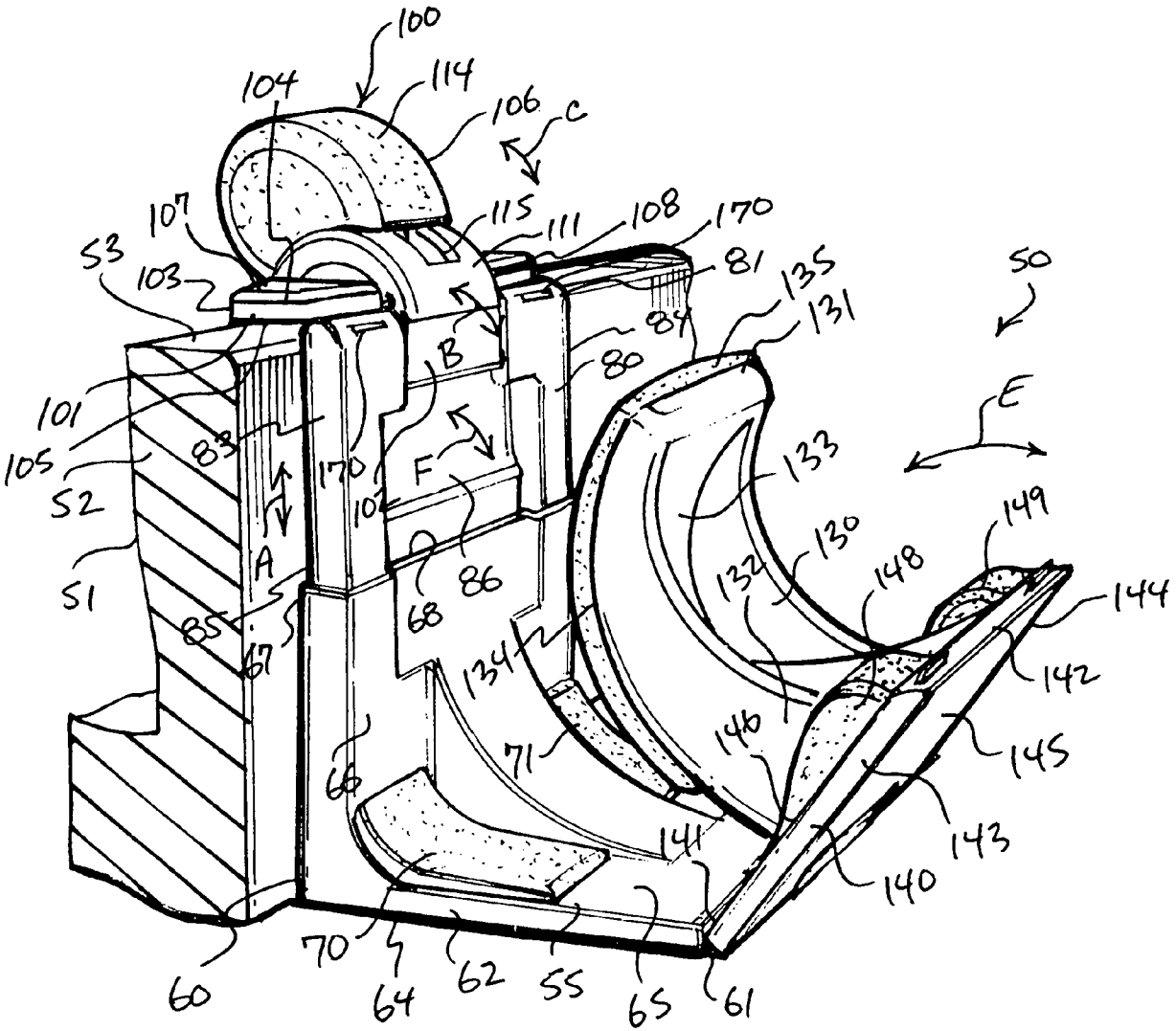
FIGS. 10-14 illustrates the sequence of steps adjusting the bath aid device from an open position as shown in FIG. 1 to a closed position as shown in FIG. 14 forming a stool.

To move bath aid device 50 from its open position to its closed upon completion of its use to assist one person in the bathing of another person, seat support 140 is pivoted from the sitting position of seat 130 as shown in FIGS. 1 and 2 to the stored position of seat 130 as shown in FIG. 11. As a matter of disclosure, FIG. 10 illustrates seat support 140 pivoted upwardly disposing seat 140 at an intermediate location between its sitting and stored positions. In the stored position of seat 130, seat 130 is directed inwardly toward upstanding support 66 and sits atop top 65 of base 55, and seat support 140 is upright extending upwardly from inner end 141 to outer end 142 and opposes and is generally parallel to upstanding support 66. According to the principle of the invention, upper end 67 of upstanding support 66 and outer end 142 of seat support 140 define a substantially horizontal plane designated at 160 in the stored position of seat 130.

Figure 13:
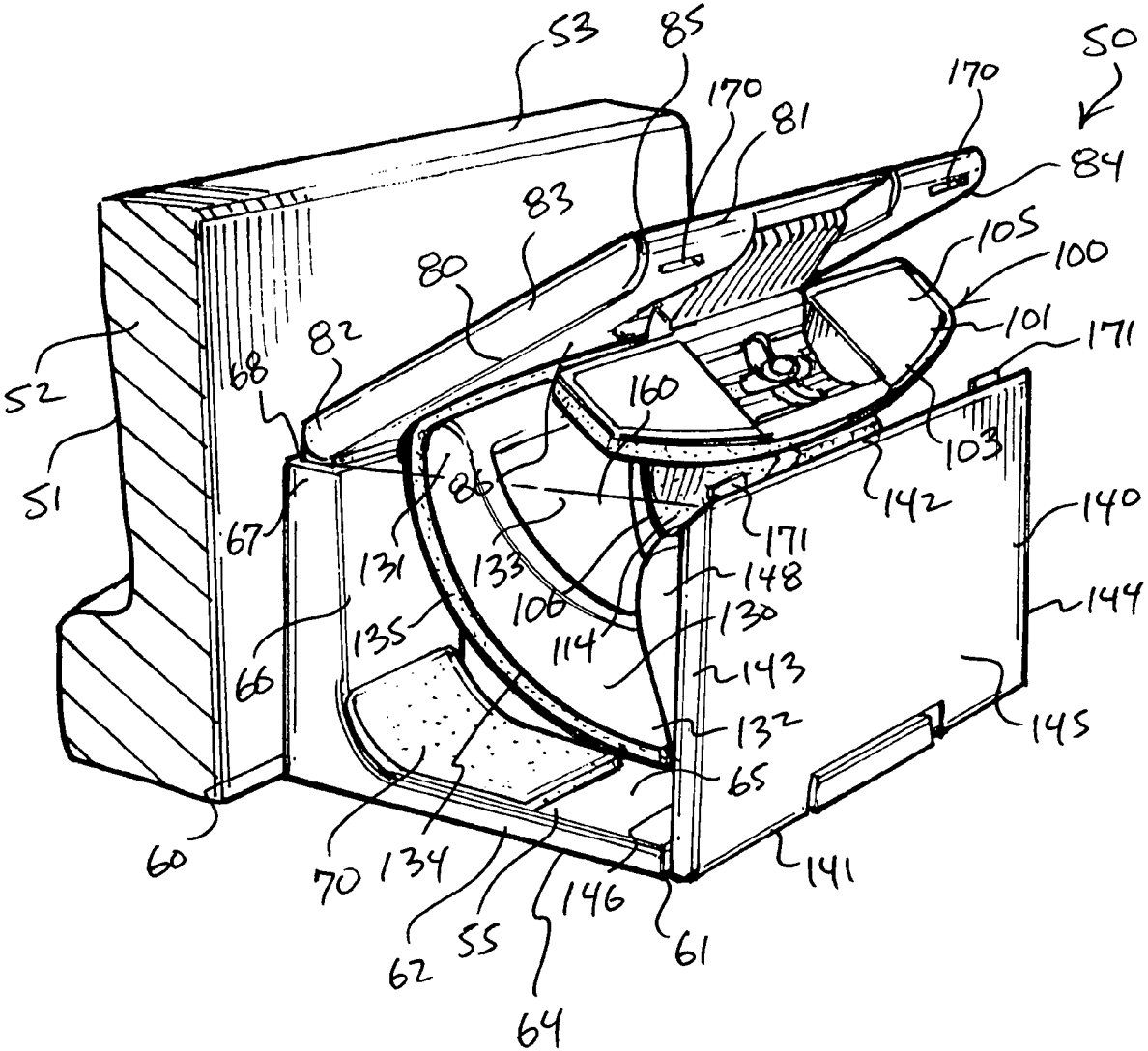

Chest support extension 80 is moved to its raised position as seen in FIG. 11 exposing the pivot or hinge between lower end 82 of chest support extension 80 and elongate insert 87 received in socket 68, and chest support 100 is pivoted from its tub-engaging position as shown in FIG. 11 to its tub-disengaging position as shown in FIG. 12 in juxtaposition with inner face 86. In the raised position of chest support extension 80 and the tub-disengaging position of chest support 100, the pivotal attachment between lower end 82 of chest support extension 80 and elongate insert 87 allows chest support extension to be pivoted as generally indicate by the arcuate double arrowed line F in FIGS. 1, 2, and 11 between its raised position disposing chest support 100 in what is considered a deployed position away from the padded area for kneeling of base 55, and a lowered, generally horizontal position as shown in FIG. 14 disposing chest support 100 in a stored position toward the padded area for kneeling. As a matter of disclosure, FIG. 13 illustrates chest support extension 80 pivoted downwardly between its raised position as shown in FIG. 11 and its lowered position shown in FIG. 14.

In the stored position of seat 130 and chest support 100 as shown in FIGS. 14 and 15, bath aid device 50 is closed and assumes a stool configuration, in which outer end 81 of chest support extension 80 sits against outer end 142 of seat support 140, and in which chest support extension 80 is supported in its lowered, generally horizontal position along horizontal plane 160 by and between upper end 67 of upstanding support 66 and outer end 142 of seat support 140. In the closed position of bath aid device 50, base 55, upstanding support 66, chest support extension 80, and seat support 140 cooperate and form an enclosure defining a storage region 175 containing chest support 100 and seat 130. In the closed position of bath aid device 50, chest support 100 is positioned atop seat 130 and opposes inner face 133. Inner face 133 is concave thereby forming a receiving area that accepts chest support 100 in the closed position of bath aid device 50. To move bath aid device 50 from its closed position to its open position, one need only reverse the foregoing operation.

When closed bath aid device 50 is a stool, namely, a low bench or portable support for the feet or knees or for sitting upon. In this regard, outer face 85 of chest support extension 80 is the load-bearing face onto which a user may sit, kneel, or step upon as seen in FIG. 17.

An engagement assembly is provided between chest support extension 80 and seat support 140, which releasably secures chest support extension 80 to seat support 140 in the stored positions of seat 130 and chest support 100, respectively. The engagement assembly includes keyways 170 carried at the terminal edge of the chest support extension 80, namely, upper end 81, and corresponding complemental keys 171 carried at the terminal edge of seat support 140, namely, outer end 142. In the stored positions of seat 130 and chest support 100, keyways 170 register with and accept keys 171 thereby releasably securing chest support extension 80 to seat support 140. Each keyway and corresponding key together constitute an engagement pair including an element thereof carried at upper end 81 of chest support extension 80 and a complemental element thereof carried by outer end 142 of seat support 140. Although keyways 170 are carried by chest support extension and keys 171 are carried by seat support 140, this can be reversed. Moreover, although chest support extension 80 incorporates two keyways 170 and seat support 140 incorporates two corresponding keys 171, less or more corresponding pairs key/keyway engagement pairs may be used without departing from the invention. Although the preferred engagement pairs each constitute a keyway 170 and a corresponding key 171, other forms of engagement pairs capable of releasably securing chest support extension 80 to seat support 140 in the stored positions of chest pad 100 and seat 130, respectively, can be used without departing from the invention, such as corresponding hook and loop fasteners, complementing detent engagement pairs, complementing tongue and groove engagement pairs, etc.

When bath aid device 50 is in its closed position, chest support extension 80 prevents seat support 140 from pivoting seat 160 from its stored position to its sitting position. Moreover, when a load is applied to upper face 85 of chest support extension 80, such as from a user standing or kneeling or sitting thereon, in the closed position of bath aid device 50, bath aid device 50 becomes locked in its closed position and is prevented from assuming its open position.

An exemplary bath aid device 50 is disclosed, which is movable between an opening position for use by one in the bathing of another in a bathtub, which is adjustable for accommodating any bathtub height, and which folds into a stool when not used for providing bathing assistance. Bath aid device 50 incorporates padded areas onto which a user may sit, kneel, and present his or her chest against and his or her ankles against when providing bathing assistance, and is configured to support a user in a forward leaning position for providing optimum comfort and reach into a tub for bathing another. Moreover, the chest pad 106 of bath aid device 50 against which a user presents his or her chest can be set to different positions for providing maximum comfort and reach into the bathtub in the forward leaning position.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A bath aid device for use with a bathtub including a bathtub wall having an upper edge, wherein the bath aid device assists one outside of the bathtub in the bathing of another within the bathtub, the bath aid device comprising:

a base, formed with a padded area for kneeling, having a inner tub-facing end positionable adjacent to the bathtub wall and an opposing outer end;

a seat carried by a seat support mounted to the outer end of the base for movement relative to the padded area for kneeling formed in the base between a sitting position of the seat away from the padded area for kneeling and a stored position of the seat near the padded area for kneeling;

a chest support, formed with a padded chest engaging area, mounted to a chest support extension and positionable on the upper edge of the bathtub wall;

the chest support extension mounted to the inner tub-facing end of the base for reciprocal movement between a lowered position of the chest support near the base for positioning against the upper edge of the bathtub wall and a raised position of the chest support away from the base, and in the raised position of the chest support for pivotal movement between a deployed position of the chest support away from the padded area for kneeling and a stored position of the chest support near the padded area for kneeling; and the chest support extension supported between the inner tub-facing end of the base and the seat support in the stored positions of the seat and the chest support.

2. The bath aid device according to claim 1, further comprising an engagement assembly for releasably securing the chest support extension to the seat support in the stored positions of the seat and the chest support, respectively, including an element thereof carried at a terminal edge of the chest support extension and a complemental element thereof carried at a terminal edge of the seat support.

3. The bath aid device according to claim 2, wherein the element comprises one of a key and a keyhole, and the complemental element comprises the other one of the key and the keyhole.

4. The bath aid device according to claim 1, further comprising a padded ankle support formed in the seat support on each side of the seat.

5. The bath aid device according to claim 1, wherein the chest support comprises:

a tub-engaging fixture having an inner end mounted to the chest support extension, an opposing outer end, an upper surface, and an opposing tub-engaging surface; and a chest pad, defining the padded chest engaging area, mounted to the tub-engaging fixture overlying the upper surface thereof.

6. The bath aid device according to claim 5, further comprising:

the chest pad further mounted to the tub-engaging fixture for movement between a first position near the inner end of the tub-engaging fixture and a second position near the outer end of the tub-engaging fixture; and a locking mechanism interacting between the chest pad and the tub-engaging fixture for releasably securing the chest pad at the first and second positions thereof and at selected positions therebetween.

7. The bath aid device according to claim 1, wherein the seat is formed with a padded area for sitting.

8. A bath aid device for use in conjunction with a bathtub including a bathtub wall having an upper edge, wherein the bath aid device assists one outside of the bathtub in the bathing of another within the bathtub, the bath aid device comprising:

a base, formed with a padded area for kneeling, having an inner tub-facing end positionable adjacent to the bathtub wall and an opposing outer end;

a seat carried by a seat support mounted to the outer end of the base for movement relative to the padded area for kneeling formed in the base between a sitting position of the seat away from the padded area for kneeling and a stored position of the seat near the padded area for kneeling;

a chest support extension having opposing inner and outer faces;

a chest support, formed with a padded chest engaging area, mounted to the chest support extension for movement between a first position away from the inner face of the chest support extension and a second position in juxtaposition with the inner face of the chest support extension, the chest support positionable on the upper edge of the bathtub wall in the first position of the chest support;

the chest support extension mounted to the inner tub-facing end of the base for reciprocal movement between a lowered position of the chest support near the base for positioning against the upper edge of the bathtub wall in the first position of the chest support and a raised position of the chest support away from the base, and in the raised position of the chest support for pivotal movement between a deployed position of the chest support away from the padded area for kneeling and, in the second position of the chest support, a stored position of the chest support near the padded area for kneeling; and in the stored positions of the seat and the chest support, and the second position of the chest support, the chest support extension supported between the inner tub-facing end of the base and the seat support, and the chest support located between the seat and the inner face of the chest support extension.

9. The bath aid device according to claim 8, further comprising an engagement assembly for releasably securing the chest support extension to the seat support in the stored positions of the seat and the chest support, respectively, including an element thereof carried at a terminal edge of the chest support extension and a complemental element thereof carried at a terminal edge of the seat support.

10. The bath aid device according to claim 9, wherein the element comprises one of a key and a keyhole, and the complemental element comprises the other one of the key and the keyhole.

11. The bath aid device according to claim 8, further comprising a padded ankle support formed in the seat support on each side of the seat.

12. The bath aid device according to claim 8, wherein the chest support comprises:

a tub-engaging fixture having an inner end, an opposing outer end, an upper surface, and an opposing tub-engaging surface, the inner end of the tub-engaging fixture mounted to the chest support extension for movement between the first and second positions of the chest support; and a chest pad, defining the padded chest engaging area, mounted to the tub-engaging fixture overlying the upper surface thereof.

13. The bath aid device according to claim 12, further comprising:

the chest pad further mounted to the tub-engaging fixture for movement between a first position near the inner end of the tub-engaging fixture and a second position near the outer end of the tub-engaging fixture; and a locking mechanism interacting between the chest pad and the tub-engaging fixture for releasably securing the chest pad at the first and second positions thereof and at selected positions therebetween.

14. The bath aid device according to claim 8, wherein the seat is formed with a padded area for sitting.

15. A bath aid device for use with a bathtub including a bathtub wall having an upper edge, wherein the bath aid device assists one outside of the bathtub in the bathing of another within the bathtub, the bath aid device comprising:

a base, formed with a padded area for kneeling, having an inner tub-facing end positionable adjacent to the bathtub wall and an opposing outer end;

an upstanding support extending upwardly from the inner tub-facing end terminating with an upper end;

a seat carried by a seat support having an inner end and an opposing outer end, the inner end of the seat support mounted to the outer end of the base for movement of the seat support relative to the padded area for kneeling formed in the base between a sitting position of the seat away from the padded area for kneeling and a stored position of the seat near the padded area for kneeling;

a chest support, formed with a padded chest engaging area, mounted to a chest support extension and positionable on the upper edge of the bathtub wall;

the chest support extension mounted to the upstanding support for reciprocal movement between a lowered position disposing the chest support near the base for positioning against the upper edge of the bathtub wall and a raised position disposing the chest support away from the base, and in the raised position for pivotal movement between the raised position disposing the chest support in a deployed position away from the padded area for kneeling and a lowered, generally horizontal position disposing the chest support in a stored position near the padded area for kneeling;

in the stored position of the seat, the upper end of the upstanding support and the outer end of the seat support defining a generally horizontal plane; and in the stored positions of the seat and the chest support, the chest support extension supported in its lowered, generally horizontal position between the upper end of the upstanding support and the outer end of the seat support.

16. The bath aid device according to claim 15, further comprising an engagement assembly for releasably securing the chest support extension to the seat support in the stored positions of the seat and the chest support, respectively, including an element thereof carried at a terminal edge of the chest support extension and a complemental element thereof carried at the outer end of the seat support.

17. The bath aid device according to claim 16, wherein the element comprises one of a key and a keyhole, and the complemental element comprises the other one of the key and the keyhole.

18. The bath aid device according to claim 15, further comprising a padded ankle support formed in the seat support on each side of the seat.

19. The bath aid device according to claim 15, wherein the chest support comprises:

a tub-engaging fixture having an inner end mounted to the chest support extension, an opposing outer end, an upper surface, and an opposing tub-engaging surface; and a chest pad, defining the padded chest engaging area, mounted to the tub-engaging fixture overlying the upper surface thereof.

20. The bath aid device according to claim 19, further comprising:

the chest pad further mounted to the tub-engaging fixture for movement between a first position near the inner end of the tub-engaging fixture and a second position near the outer end of the tub-engaging fixture; and a locking mechanism interacting between the chest pad and the tub-engaging fixture for releasably securing the chest pad at the first and second positions thereof and at selected positions therebetween.

* * * * *